United States Patent [19]

Webb

[11] Patent Number: 5,033,382

[45] Date of Patent: Jul. 23, 1991

[54] PIEZOELECTRIC FUSE FOR PROJECTILE WITH SAFE AND ARM MECHANISM

[75] Inventor: George Webb, Larwill, Ind.

[73] Assignee: Magnavox Government and Industrial Electronics Company, Fort Wayne, Ind.

[21] Appl. No.: 234,584

[22] Filed: Aug. 22, 1988

Related U.S. Application Data

[62] Division of Ser. No. 30,142, Mar. 25, 1987, Pat. No. 4,793,256.

[51] Int. Cl.[5] ..... F42C 11/02

[52] U.S. Cl. ..... 102/235; 102/210

[58] Field of Search ..... 102/235, 244, 251, 262, 102/231, 233, 210, 216

[56] References Cited

U.S. PATENT DOCUMENTS

| | | | |
|---|---|---|---|
| 2,458,468 | 1/1949 | Flett | 102/235 |
| 2,892,411 | 6/1959 | Brown et al. | 102/210 |
| 3,031,968 | 5/1962 | Dowdell et al. | 102/210 |
| 3,256,817 | 6/1966 | Rabinow et al. | 102/210 |
| 3,603,259 | 9/1971 | Webb | 102/235 |
| 3,742,857 | 7/1973 | Schmidt et al. | 102/210 |
| 3,842,742 | 10/1974 | Harnau | 102/210 |
| 4,026,214 | 5/1977 | Backstein | 102/210 |
| 4,464,991 | 8/1984 | Kaiser | 102/233 |
| 4,606,272 | 8/1986 | Kerdraon | 102/210 |
| 4,662,279 | 5/1987 | Popovitch | 102/233 |

OTHER PUBLICATIONS

Arradcom, DRDAR-SCA-CF, M505A3 20 mm projectile Oct. 1, 1980.

*Primary Examiner*—David H. Brown

*Attorney, Agent, or Firm*—Roger M. Rickert; Thomas A. Briody; Richard T. Seeger

[57] ABSTRACT

A piezoelectric fuse, and safe and arm mechanism for a small active projectile is disclosed including a piezoelectric element mounted within the projectile near the leading end thereof with an impact deformable electrically conductive shell spaced from and at least partially surrounding the piezoelectric element and a resilient material substantially filling the space between the piezoelectric element and the shell. Electrical leads connect the detonator to the shell and to a rearward piezoelectric element contact so that upon projectile impact, the shell deforms compressing the piezoelectric element generating a voltage thereacross, and thereafter, the shell makes electrical connection with a piezoelectric element forward contact actuating the detonator. The safe and arm mechanism includes an interrupter located in a "safe" position between the detonator and a lead charge. The interrupter may move from the safe position only upon both sufficient angular velocity and sufficient linear acceleration of the projectile.

14 Claims, 2 Drawing Sheets

PIEZOELECTRIC FUSE FOR PROJECTILE WITH SAFE AND ARM MECHANISM

This application is a division of my copending application Ser. No. 030,142 filed Mar. 25, 1987, now U.S. Pat. No. 4,793,256 granted Dec. 27, 1988.

SUMMARY OF THE INVENTION

The present invention relates generally to active small caliber projectiles and more particularly to a safe and arm mechanism in conjunction with a piezoelectric fuse arrangement for such projectiles.

A great deal of technology on large caliber explosive shells such as artillery shells has been developed. Such artillery shells have a projectile which carries an explosive charge which typically either explodes on impact with a target or explodes a preset time after being discharged from a gun. Timed burning fuses, mechanical impact actuated explosive materials, and electrical detonating devices which are actuated upon impact have been successfully employed, but none are well suited for use in small, i.e., on the order of 50 caliber, weapons. For example, U.S. Pat. No. 4,026,214 discloses an inertial mass behind a piezoelectric crystal which mass compresses the crystal when the projectile strikes a target with the compression generating a voltage triggering the shell detonator. As another example, U.S. Pat. No. 2,892,411 illustrates an ordinance missile having a crushable casing which compresses a crystal. In this patented arrangement, a fine wire which normally shorts the crystal is broken when the missile is fired thus arming the device.

There is a continuing need for small caliber explosive projectiles for use, for example, as armor piercing projectiles, which may be fired from conventional hand held or portable weapons. Illustrative of the attempts in this area in U.S. Pat. No. 3,842,742 where a ring shaped ceramic piezoelectric element is positioned in the nose of a projectile. In this patented arrangement, the goal is to reduce the mass in between the target being impacted and the charge carried in the projectile. "Small-caliber" in this patent refers to shells in the 20–40 mm. (about ¾ to 1½ inch diameter) range. Neither this patented arrangement nor the earlier mentioned ones are suitable for downsizing to truly small hand held weapons on the order of 50 caliber. In the present application, "small" projectiles have an upper bound on projectile diameter at about the lower bound of the lastmentioned patent with 50 caliber being a good illustrative size.

An arrangement for discharging an active small projectile, for example, one containing a shaped charge for armor piercing applications, has several unique requirements. The projectile should have ballistic characteristics which are close to those of other type projectiles normally fired in the weapon. The fuse must be quick acting since the projectile has a rather high velocity (nearly 3,000 feet per second for a 50 caliber projectile) and may deform significantly during the time it takes for the fuse to act. Inertia actuation is typically too slow. The detonator should be located in the base of the projectile behind the shaped charge and the mass of material between the charge and the target should be kept as small as possible. The shaped charge should detonate at a preferred stand-off or separation between the charge itself and the target.

Among the several objects of the present invention may be noted the provision of a simple and economical piezoelectric generator that will initiate an electrical detonator upon target impact; the provision of an impact actuated piezoelectric generator for triggering a detonator which maintains complete electrical isolation of the detonator until impact with the target, stores sufficient electrical energy to fire the detonator before the firing circuit is completed so as to provide adequate energy in minimum time, and provides a degree of fail safe operation where the firing circuit is likely to fail if detonator function does not occur; and the provision of a safe and arm arrangement in the base or trailing portion of an active projectile which requires both linear acceleration and angular velocity of the projectile before arming takes place. These as well as other objects and advantageous features of the present invention will be in part apparent and in part pointed out hereinafter.

In general, an impact actuated piezoelectric generator arrangement for triggering the detonator includes a piezoelectric element mounted within the projectile near the leading end thereof having forward and rearward electrical contacts. An impact deformable electrically conductive shell is spaced from and at least partially surrounds the piezoelectric element and a resilient material substantially fills the space between the piezoelectric element and the shell. An arrangement for electrically connecting the detonator to the shell and to the rearward piezoelectric element contact is provided so that upon projectile impact, the shell deforms compressing the piezoelectric element generating a voltage thereacross, and then the shell makes electrical connection with the piezoelectric element forward contact actuating the detonator.

Also in general and in one form of the invention, a safe and arm mechanism for a small shaped charge containing projectile of the type having a detonator spaced from and aligned with a lead charge for detonating the shaped charge has a disk shaped interrupter normally interposed between the detonator and the lead charge for preventing detonator activation from actuating the shaped charge. A mechanical arrangement for normally blocking the interrupter is responsive to linear acceleration along a central axis of the projectile upon the projectile being fired from a gun to move from its normal interrupter blocking position. A second mechanical arrangement for normally blocking the interrupter is responsive to rotation of the projectile to move from its normal interrupter blocking position with the interrupter being freed to move in response to projectile rotation from its normal position interposed between the detonator and the lead charge to a position where detonator activation may actuate the shaped charge only when both the first and second mechanical arrangements have moved from their respective interrupter blocking positions.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
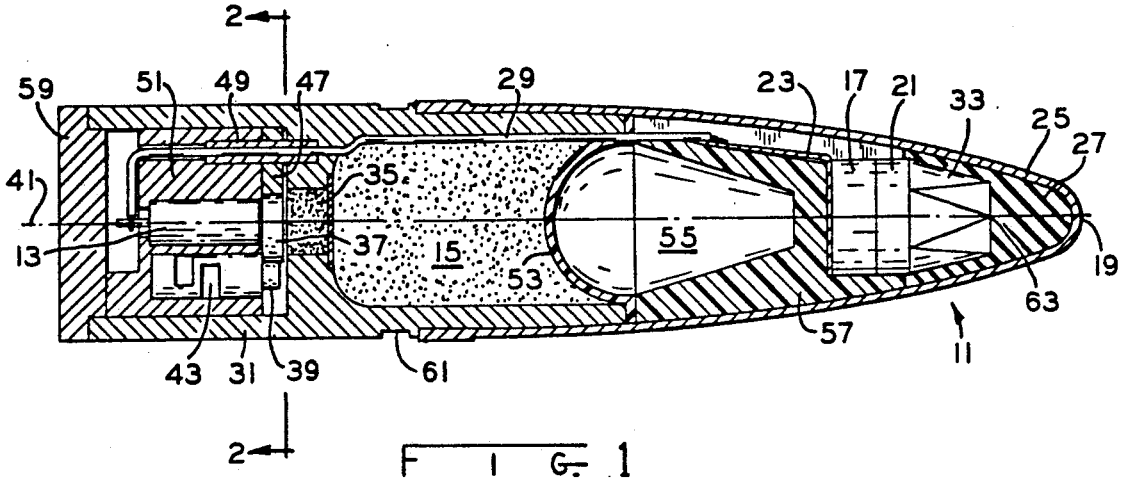
FIG. 1 is a view in cross-section of a projectile incorporating the present invention in one form.

In FIG. 1, a small active projectile 11 has an electrically triggerable detonator 13 for firing a shaped charge 15, and an impact actuated piezoelectric generator arrangement for triggering the detonator 13 comprising a piezoelectric element 17 mounted within the projectile 11 near the leading end 19 thereof and having forward 21 and rearward 23 electrical contacts. An impact deformable electrically conductive shell 25 is spaced from and at least partially surrounds the piezoelectric element 17 and a resilient insulating material 27 substantially fills the space between the piezoelectric element 17 and its associated forward contact 21, and the shell 25. Rear contact 23 extends rearwardly and connects to an insulated lead wire 29 which in turn extends further rearwardly through the central opening in roll pin 49 to the detonator 13. The outer shell or ogive 25 electrically contacts the conductive body 31 which by way of an aluminum housing 51 contacts the conductive casing of the detonator 13 thereby electrically connecting the detonator 13 to the shell 25 and to the rearward piezoelectric element contact 23 so that upon projectile impact, the conductive copper alloy shell 25 deforms compressing the resilient material 27 and therefore also compressing the piezoelectric element 17 generating a voltage thereacross. Upon further deformation of the shell 25, the serrated portion 33 of the forward contact 21 cuts through the resilient material 27 and the shell makes electrical connection with the piezoelectric element forward contact actuating the detonator. Thus, the forward electrical contact comprises a serrated forward surface which upon sufficient shell deformation cuts through the resilient material and makes electrical contact with the shell.

The piezoelectric generator output is enhanced by initial shell deformation which induces a corresponding piezoelectric element deformation thereby providing an enhanced energy output from the piezoelectric element when the circuit is completed by the contact sharp end cutting through the rubberlike material 27. The shell 25 comprises the outer surface of at least the leading end of the projectile and the detonator and piezoelectric element are fixed relative to the projectile with the shaped charge positioned intermediate the detonator and the piezoelectric element.

The brass alloy contact 21 and forward portion 33 with its sharp edges 63 may be formed as one piece bonded by a conductive epoxy layer to the front surface of crystal 17 or the forward portion 33 may be formed as a separate piece if desired. Contact 23, also of a brass alloy, may have an enlarged circular surface similarly bonded by a conductive epoxy resin to the rear or trailing surface of crystal 21. Electrical isolation between the contacts of the crystal is maintained while support for the crystal is provided by nylon support 57.

Near the rear of the projectile 11 is located a safe and arm mechanism for the small shaped charge containing projectile. The projectile is of the type having a detonator 13 spaced from and aligned with a lead charge 35 for detonating the shaped charge 15. The shaped effect of charge 15 may be enhanced by an empty space 55 forward of the liner 53. A disk shaped hardened steel interrupter 37 is normally interposed between the detonator 13 and the lead charge 35 for preventing detonator activation from actuating the shaped charge 15. The lead charge may be contained in a thin metal cup. A first means including the setback pin 39 normally blocks the interrupter 37 in the position shown in FIGS. 1 and 2, but is responsive to linear acceleration along a central axis 41 of the projectile upon the projectile being fired from a gun to move from its normal interrupter blocking position. The brass setback pin 39 has an intermediate relieved portion in the form of slots 43 and 45 best seen in FIG. 4, which collapse (compare FIGS. 1 and 4) thereby effectively shortening the pin under sufficient linear acceleration. A second means in the form of a spin lock member 47 also normally blocks the interrupter 37 and is responsive to rotation of the projectile to move from its normal interrupter blocking position. This second means comprises the generally C-shaped spin lock member 47, best seen in FIG. 2, which partially encircles the interrupter 37 thereby restraining the interrupter. The space between the ends of the C open or spread apart, as in FIG. 3, to a dimension sufficient to allow passage of the interrupter therebetween under adequate projectile angular velocity. Thus, the interrupter is freed to move radially in response to projectile rotation from its normal position interposed between the detonator and the lead charge (FIG. 1) to a position (FIG. 4) where detonator activation may actuate the shaped charge only when both the first and second means have moved from their respective interrupter blocking positions.

Figure 4:
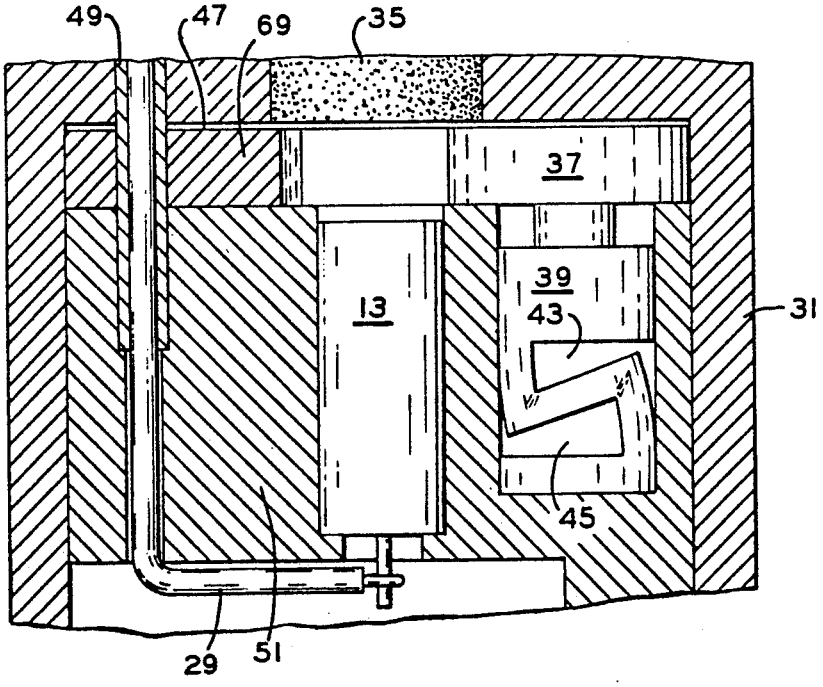
FIG. 4 is a view in cross-section along line 4—4 of FIG. 3.
Figure 2:
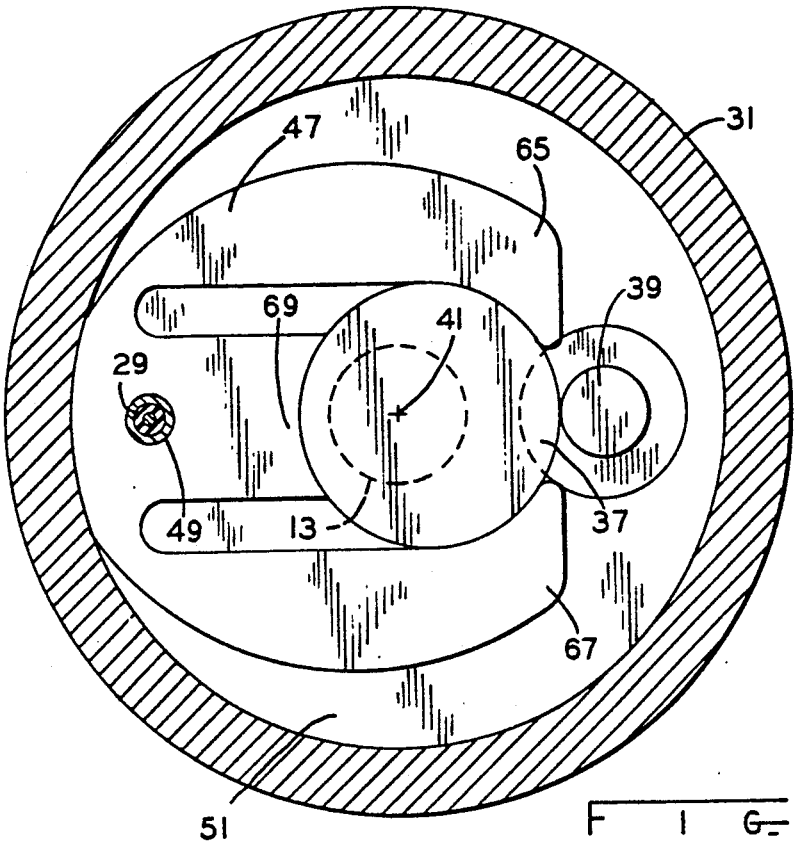
FIG. 2 is a view in cross-section along line 2—2 of FIG. 1.
Figure 3:
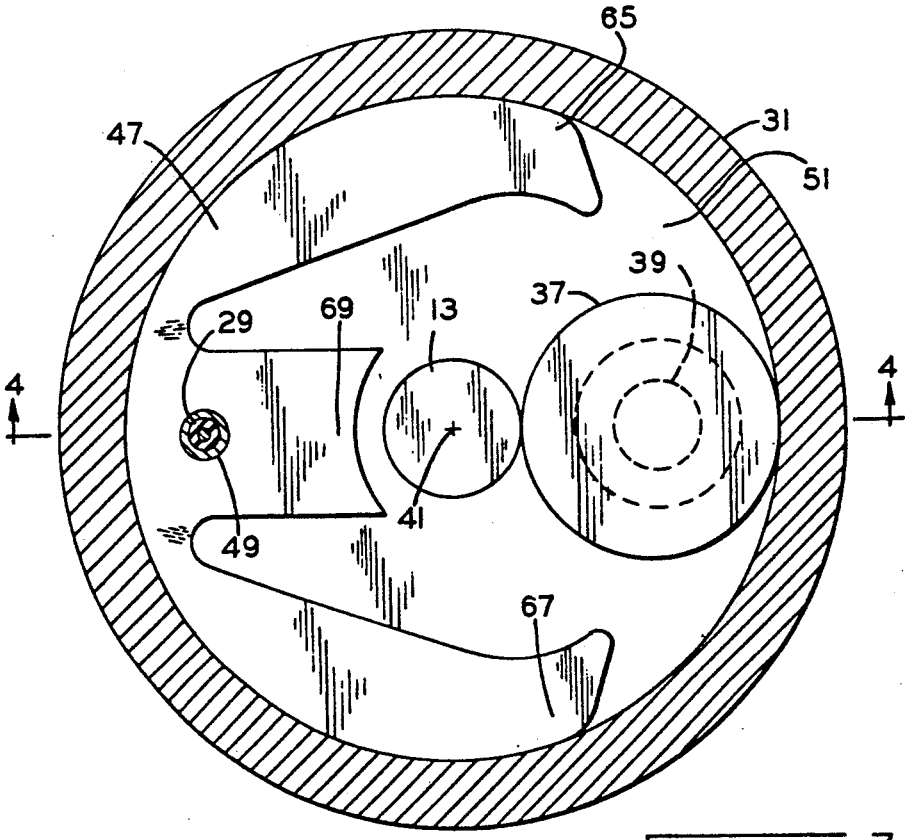
FIG. 3 is a view like FIG. 2, but showing the components in their "armed" positions.

Comparing the "safe configuration of FIGS. 1 and 2 with the "armed" configuration of FIGS. 3 and 4, it will be noted that the setback pin 39 extends along the interrupter 37 near the space between the ends of the C and collapses due to inertia generally parallel to the axis 41 to clear the space between the ends of the C. The inner C surface is generally circular and confines the disk shaped interrupter 37 which is also generally circular with the center of the disk near the axis 41. For centrifugal force to be effective in moving the disk 37 to the "ready to fire" position, the center of the disk is preferably displaced from the axis 41 slightly toward the opening between the ends of the C.

The roll pin 49 not only provides a passage for insulated lead 29, but also holds the center rest portion 69 of spin lock 47 in place. The center rest 69 abuts the shutter or interrupter 37 to insure that if the shutter moves laterally, it must move over the retracted set back pin 39.

The projectile as so far described, would replace a conventional inert bullet in a 50 caliber cartridge and be held in place by crimping the case neck into crimp groove 61. When the cartridge is fired, the hot expanding gasses impinge on hardened steel base 59 seated in the rear of steel body 31 with the projectile being protected from the heat and strain by the base. When the projectile is discharged from its cartridge case and accelerates down the rifled barrel of a gun, it experiences linear acceleration which causes the setback pin 39 to collapse. The twist of the barrel rifling also imparts an angular velocity to the projectile about the central axis 41 which, due to centrifugal force, causes a plastic deformation (a spreading or separating) of the arms 65 and 67 of the aluminum spin lock 47 freeing the interrupter or shutter 37 to move, again due to centrifugal force, to the position shown in FIGS. 3 and 4.

When the projectile impacts a target, nose cone or ogive 25 deforms compressing the crystal 17 by way of the rubber liner 27 and forward contact 21. Further deformation of the ogive 25 causes sharp edges such as 63 of the front portion 33 of contact 21 to cut through the liner 27 and make electrical connection with ogive 25. This connection enables the transfer of energy stored in the stressed crystal to be transferred to the detonator, activating the detonator which in turn actuates the shaped charge 15.

From the foregoing, it is now apparent that a novel arrangement has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. In an active projectile of the type having an electrically triggerable detonator spaced from and aligned with a lead charge for firing a shaped charge, the combination comprising:

a disk shaped interrupter normally interposed between the detonator and the lead charge for preventing detonator activation from actuating the shaped charge;

first means normally blocking the interrupter and responsive to linear acceleration along a central axis of the projectile upon the projectile being fired from a gun to move from its normal interrupter blocking position;

second means normally blocking the interrupter and responsive to rotation of the projectile to move from its normal interrupter blocking position;

the interrupter being freed to move in response to projectile rotation from its normal position interposed between the detonator and the lead charge to a position where detonator activation may actuate the shaped charge only when both the first and second means have moved from their respective interrupter blocking positions.

2. The combination of claim 1 wherein the first means comprises a setback pin having an intermediate relieved portion which collapses thereby effectively shortening the pin under sufficient linear acceleration.

3. The combination of claim 1 wherein the second means comprises a generally C-shaped spin lock member partially encompassing the interrupter, the space between the ends of the C opening to a dimension sufficient to allow passage of the interrupter therebetween under adequate projectile angular velocity.

4. The combination of claim 3 wherein the first means comprises a setback pin having an intermediate relieved portion which collapses thereby effectively shortening the pin under sufficient linear acceleration.

5. The combination of claim 4 wherein the setback pin extends along the interrupter near the space between the ends of the C and collapses generally parallel to the axis to clear the space between the ends of the C.

6. The combination of claim 3 wherein the inner C surface is generally circular and confines the disk with the center of the disk near the axis.

7. The combination of claim 6 wherein the center of the disk is displaced from the axis slightly toward the opening between the ends of the C.

8. The combination of claim 1 further comprising:

a piezoelectric element mounted within the projectile near the leading end thereof and having forward and rearward electrical contacts;

an impact deformable electrically conductive shell spaced from and at least partially surrounding the piezoelectric element;

a resilient material substantially filling the space between the piezoelectric element and the shell; and means electrically connecting the detonator to the shell and to the rearward piezoelectric element contact so that upon projectile impact, the shell deforms compressing the piezoelectric element generating a voltage thereacross, and the shell makes electrical connection with the piezoelectric element forward contact actuating the detonator.

9. The combination of claim 8 wherein the detonator and piezoelectric element are fixed relative to the projectile with the shaped charge positioned intermediate the detonator and the piezoelectric element.

10. The combination of claim 8 wherein the forward electrical contact comprises a serrated forward surface which upon shell deformation cuts through the resilient material and makes electrical contact with the shell.

11. The combination of claim 8 wherein the shell comprises the outer surface of at least the leading end of the projectile, initial shell deformation inducing a corresponding piezoelectric element deformation thereby providing an enhanced energy output from the piezoelectric element when the circuit is completed.

12. The combination of claim 8 wherein the first means comprises a setback pin having an intermediate relieved portion which collapses thereby effectively shortening the pin under sufficient linear acceleration.

13. The combination of claim 8 wherein the second means comprises a generally C-shaped spin lock member partially encompassing the interrupter, the space between the ends of the C opening to a dimension sufficient to allow passage of the interrupter therebetween under adequate projectile angular velocity.

14. The combination of claim 13 wherein the first means comprises a setback pin having an intermediate relieved portion which collapses thereby effectively shortening the pin under sufficient linear acceleration, the setback pin extending along the interrupter near the space between the ends of the C and collapsing generally parallel to the axis to clear the space between the ends of the C.

* * * * *